US007752972B1

(12) United States Patent
Baker et al.

(10) Patent No.: US 7,752,972 B1
(45) Date of Patent: Jul. 13, 2010

(54) LOW REACTION RATE, HIGH BLAST SHAPED CHARGE WAVESHAPER

(75) Inventors: Ernest L. Baker, Wantage, NJ (US); James D. Pham, Randolph, NJ (US); Arthur S. Daniels, Rockaway, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 496 days.

(21) Appl. No.: 11/858,978

(22) Filed: Sep. 21, 2007

Related U.S. Application Data

(63) Continuation-in-part of application No. 11/465,572, filed on Aug. 18, 2006, now abandoned.

(60) Provisional application No. 60/595,999, filed on Aug. 23, 2005.

(51) Int. Cl.
*F42B 1/02* (2006.01)

(52) U.S. Cl. ..... 102/309; 102/476

(58) Field of Classification Search ..... 102/476, 102/305, 306, 307, 308, 309, 310
See application file for complete search history.

(56) References Cited

U.S. PATENT DOCUMENTS

| | | | | |
|---|---|---|---|---|
| 4,594,946 | A * | 6/1986 | Ringel et al. | 102/307 |
| 4,672,896 | A * | 6/1987 | Precoul et al. | 102/309 |
| 4,896,609 | A * | 1/1990 | Betts et al. | 102/309 |
| 5,259,317 | A * | 11/1993 | Lips | 102/307 |
| 6,467,416 | B1 * | 10/2002 | Daniels et al. | 102/476 |

* cited by examiner

*Primary Examiner*—James S Bergin
(74) *Attorney, Agent, or Firm*—Michael C. Sachs

(57) ABSTRACT

A shaped charge warhead having a longitudinal axis includes a casing; a liner disposed in the casing; an explosive disposed behind the liner; a wave shaper disposed in the explosive, the wave shaper comprising a low reaction rate high blast reactive material; and a detonator disposed adjacent the explosive. Preferably, the wave shaper is symmetrical about the longitudinal axis. The low reaction rate, high-blast material may be, for example, one of powdered silicon or boron and powdered silicon or boron in a plastic matrix.

10 Claims, 1 Drawing Sheet

LOW REACTION RATE, HIGH BLAST SHAPED CHARGE WAVESHAPER

CROSS-REFERENCE TO RELATED APPLICATIONS

This application is a continuation-in-part of U.S. patent application Ser. No. 11/465,572 filed on Aug. 18, 2006 now abandoned, which claims the benefit of U.S. provisional patent application 60/595,999, filed on Aug. 23, 2005.

STATEMENT OF GOVERNMENT INTEREST

The inventions described herein may be manufactured, used and licensed by or for the U.S. Government for U.S. Government purposes.

BACKGROUND OF THE INVENTION

The invention relates in general to munitions and in particular to shaped charge warheads.

Shaped charge warheads are used in military applications for the defeat of armored targets. These devices comprise a shaped charge liner (typically conical in shape) that is backed by a high explosives charge. When the explosive is detonated, the expanding gasses collapse the liner onto itself forming a high-velocity forward moving jet. As the detonation wave continues to sweep forward, more of the liner is collapsed and fed into the jet. Since the jet tip moves faster than the tail, the jet stretches as it moves down the shot line—the longer it stretches, the deeper the penetration.

Wave shaping devices have long been used to alter the collapse dynamics of the shaped charge liner by changing the incident angle and liner sweep velocity of the impinging detonation wave. By directing the detonation front to the warhead periphery, parameters such as jet tip velocity, accumulated jet mass, jet length, and jet breakup times can be altered. In particular, wave shaping can be used to reduce head height (distance between liner apex and detonator) while maintaining penetration and thus reducing the overall length of a warhead.

Since World War II, traditional wave shaping has been accomplished through mechanical means by inserting a barrier type device in the detonation path to divert the wave to the outside edge of the warhead. Wave shapers can significantly increase penetration performance against armor. In addition, the blast output from the contained explosive in the warhead can also be used against other targets such as personnel, light vehicles, helicopters, or structural targets such as buildings and bunkers. However, for blast effects, the wave shaper volume is parasitic in nature since they are generally made from inert materials. Thus, they provide no added explosive output (non-energy contributing). By replacing these inert wave shaping materials with low-reaction rate, high-blast producing reactive materials, the wave shaping volume can be used to produce increased lethal blast effects that are not achievable in current shaped charge warheads.

The explosive output of a reactive wave shaper can be differentiated between blast and incendiary effects. Incendiary devices are designed to start fires and are characterized by high heat output and light. These types of materials provide increased temperature on the target and are primarily good for igniting combustible materials such as diesel fuel or timber structures. U.S. Pat. No. 5,259,317 issued on Nov. 9, 1993 shows a hollow charge having a wave guide made of an incendiary material.

Blast output may be characterized by the ability of the system to transfer blast energy to displace a target and perform work. The application of this force over time produces a significant impulse that is capable of knocking down buildings, damaging structures and causing lethality due to the blast overpressure. The ability to create an increased pressure impulse is the desired trait for a blast material. Shaped charges having wave shapers formed from low-reaction rate, high-blast producing reactive materials are not known.

SUMMARY OF THE INVENTION

It is an object of the invention to provide a shaped charge with a wave shaping device made of a low-reaction rate, high-blast reactive material to increase blast overpressure over time (impulse).

It is another object of the invention to provide a shaped charge with a wave shaping device wherein the shaped charge is more lethal than the known shaped charge.

One aspect of the invention is a shaped charge warhead having a longitudinal axis, the shaped charge warhead comprising a casing; a liner disposed in the casing; an explosive disposed behind the liner; a wave shaper disposed in the explosive, the wave shaper comprising a low reaction rate, high-blast reactive material; and a detonator disposed adjacent the explosive.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Known shaped charge warheads commonly incorporate wave shapers to achieve desired jet characteristics. However, for blast effects, wave shapers are parasitic volumes because they occupy space that could be occupied by explosive material. By replacing these inert wave shaping materials with low-reaction rate, high blast producing reactive materials, the wave shaping volume can be used to produce increased lethal effects that are not achievable in current shaped charge warheads. In the invention, the wave shaping volume is filled with a blast material that produces work to destroy structural targets, as opposed to an incendiary material that produces heat and light for burning applications. Good blast producing materials include boron or silicon mixed with oxidizing materials.

Figure 1:
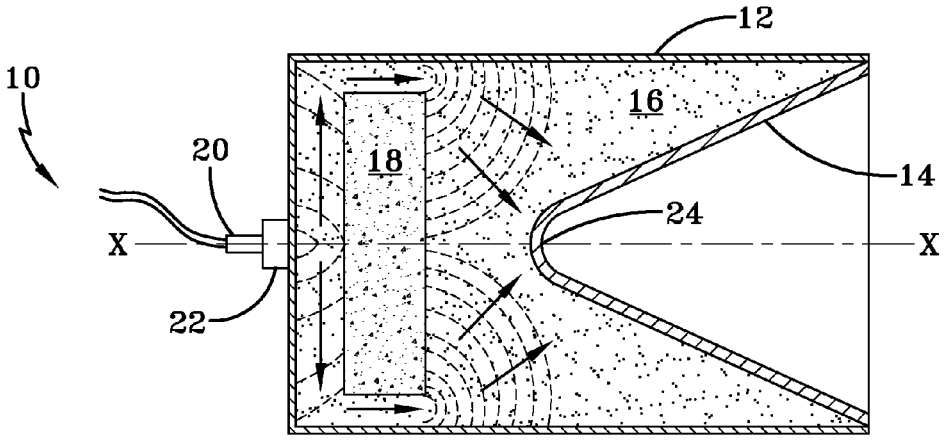
FIG. 1 is a schematic sectional view of a shaped charge warhead.

FIG. 1 is a schematic sectional view of a shaped charge warhead 10. The warhead 10 may be hand placed prior to detonation or may be part of the warhead of a missile or gun launched projectile. Warhead 10 has a longitudinal axis X, a casing 12, a liner 14 disposed in the casing 12, an explosive 16 disposed behind the liner 14, a wave shaper 18 disposed in the explosive 16, a detonator 20 disposed adjacent the explosive 16, and, if needed, a booster 22 adjacent the detonator 20.

The wave shaper 18 comprises a low reaction rate, high-blast reactive material. A suitable material for the wave shaper 18 is, for example, powdered silicon or boron or powdered silicon or boron in a plastic matrix. While not required, the wave shaper 18 is preferably symmetrical about the longitudinal axis X. The wave shaper 18 is disposed in the explosive 16 between the detonator 20 and the vertex 24 of the liner 14. In a preferred embodiment, the wave shaper 18 is disposed adjacent the rear end of casing 12, with a small amount of explosive 16 disposed between the wave shaper 18 and the rear of the casing. That is, the distance from the detonator 20 to the wave shaper 18 is preferably less than the distance from the vertex 24 of the liner 14 to the wave shaper 18.

Figure 2A:
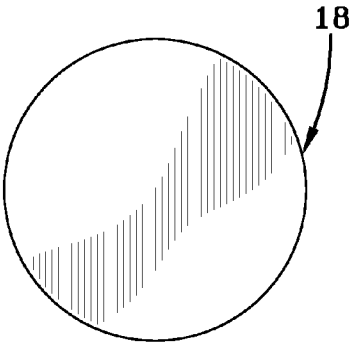
FIG. 2A is a top view of a wave shaper.
Figure 2B:
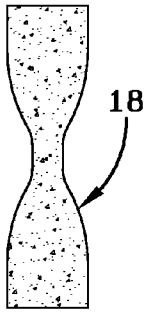
FIGS. 2B-F are side sectional views of several wave shapers.
Figure 2C:
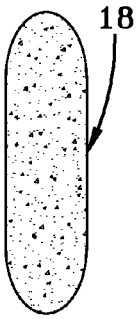
Figure 2D:
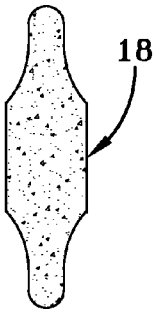
Figure 2E:
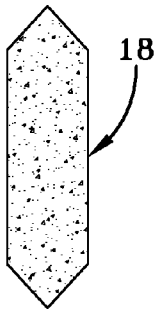
Figure 2F:
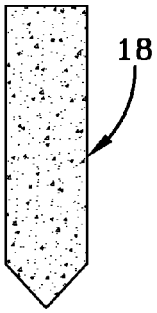

FIG. 2A is a top view of a wave shaper 18. In some embodiments, the wave shaper 18 is a circular disc, as shown in FIG. 2A, with a rectangular cross-section, as in FIG. 1. Other shapes are also possible. In addition, a variety of sectional shapes are possible. FIGS. 2B-F are side sectional views of several exemplary wave shapers. FIG. 2B shows a narrowed middle, FIG. 2C shows rounded edges, FIGS. 2D and 2E show narrowed ends, and FIG. 2F shows an asymmetrical section. The particular shape, size and exact location of the wave shaper 18 in the explosive 16 depends on the particular requirements for the shaped charge warhead 10. The wave shaper 18 may be made of more than one type of material.

In shaped charge warhead 10, the detonator 20 is initiated to set off the booster 22. The booster 22 creates a detonation wave (shown in dotted lines) that follows a detonation path (shown with arrows) in the explosive 16. As the detonation wave travels, it is redirected by the wave shaper 18 to alter the collapse angle of the liner 14. The detonation wave reaches the liner 14 and a jet forms. After the detonation wave has passed the wave shaper 18, the low reaction rate high blast wave shaper 18 reacts. The wave shaper 18 makes a high blast, or is dispersed and subsequently reacts with air to create increased blast. The low reaction rate high blast wave shaper 18 may react by itself or with air, depending on its properties.

The method of inserting the wave shaper 18 in the shaped charge warhead 10 may be similar to the known method of inserting an inert wave shaper. The explosive 16 is pressed or cast and then a cavity in the explosive 16 is machined out. The wave shaper 18 is inserted in the cavity. An explosive cap is then glued to the wave shaper/explosive assembly.

The inventive warhead 10 uses a low-reaction rate, high-blast reactive material for wave shaper 18. The warhead 10 produces both high precision shaped charge performance, as well as increased blast. This in turn produces increased lethality against a broader range of targets including armor, urban structures, bunkers and personnel.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A shaped charge warhead having a longitudinal axis, the shaped charge warhead comprising:

a casing;

a liner disposed in the casing;

an explosive disposed behind the liner;

a wave shaper disposed in the explosive, the wave shaper comprising a low reaction rate, high-blast reactive material; and a detonator disposed adjacent the explosive.

2. The shaped charge warhead of claim 1 wherein the wave shaper is symmetrical about the longitudinal axis.

3. The shaped charge warhead of claim 1 wherein the wave shaper is disposed in the explosive between the detonator and a vertex of the liner.

4. The shaped charge warhead of claim 3 wherein a distance from the detonator to the wave shaper is less than a distance from the vertex of the liner to the wave shaper.

5. The shaped charge warhead of claim 1 wherein the low reaction rate, high-blast material comprises silicon.

6. The shaped charge warhead of claim 5 wherein the low reaction rate, high-blast material comprises powdered silicon.

7. The shaped charge warhead of claim 5 wherein the low reaction rate, high-blast material comprises silicon in a plastic matrix.

8. The shaped charge warhead of claim 1 wherein the low reaction rate, high-blast material comprises boron.

9. The shaped charge warhead of claim 8 wherein the low reaction rate, high-blast material comprises powdered boron.

10. The shaped charge warhead of claim 8 wherein the low reaction rate, high-blast material comprises boron in a plastic matrix.

* * * * *